US006116534A

United States Patent [19]

Morand

[11] Patent Number: 6,116,534

[45] Date of Patent: Sep. 12, 2000

[54] DISPENSER FOR SUPPORTING A ROLL OF PAPER TOWELS IN AN UPRIGHT ORIENTATION

[75] Inventor: Michel Morand, Montreal, Canada

[73] Assignee: Fort James Corporation, Deerfield, Ill.

[21] Appl. No.: 09/093,183

[22] Filed: Jun. 8, 1998

[51] Int. Cl.[7] ..... B65H 16/04

[52] U.S. Cl. ..... 242/597.7; 242/597.5

[58] Field of Search ..... 242/597, 597.5, 242/597.6, 597.7, 423, 550; D6/521

[56] References Cited

U.S. PATENT DOCUMENTS

| | | | |
|---|---|---|---|
| D. 147,623 | 10/1947 | Silvers | D6/521 |
| D. 166,534 | 4/1952 | Grady . | |
| D. 266,885 | 11/1982 | Youngman | D6/521 |
| D. 267,062 | 11/1982 | Lentz . | |
| D. 298,290 | 11/1988 | Wilkerson . | |
| D. 356,226 | 3/1995 | Hay . | |
| D. 389,685 | 1/1998 | Marroquin . | |
| 2,928,618 | 3/1960 | Locke | 242/597.7 |
| 3,168,258 | 2/1965 | Schwartz | 242/597.7 |
| 3,407,980 | 10/1968 | Addison | 242/597.7 |
| 3,792,822 | 2/1974 | Underhill | 242/597.5 |
| 4,102,513 | 7/1978 | Guard | 242/597.7 |
| 4,248,391 | 2/1981 | Ness | 242/597.6 |
| 4,487,376 | 12/1984 | Compton . | |
| 4,714,211 | 12/1987 | Hwang | 242/597.5 |
| 4,792,102 | 12/1988 | Olson . | |
| 5,467,956 | 11/1995 | Herr . | |
| 5,799,895 | 9/1998 | Michaud et al. . | |
| 5,816,553 | 10/1998 | Brown | 242/570 |

*Primary Examiner*—Donald P. Walsh
*Assistant Examiner*—William A. Rivera
*Attorney, Agent, or Firm*—Burns, Doane, Swecker & Mathis, L.L.P.

[57] ABSTRACT

An upright dispenser is adapted to support a roll of paper towels wound on a disposable core. The dispenser comprises a base adapted to be supported on a support surface, and a post projecting upwardly from the base and sized to be received within the core of the roll. A top surface of the post is slanted obliquely relative to a longitudinal axis of the post, whereby one side of the top surface is higher than a diagonally opposite side thereof, to facilitate the entry of the post into a deformed end of a core. A platform extends concentrically about a lower end of the post for supporting the roll. The platform is of smaller diameter than a largest diameter of a full roll.

15 Claims, 4 Drawing Sheets

DISPENSER FOR SUPPORTING A ROLL OF PAPER TOWELS IN AN UPRIGHT ORIENTATION

BACKGROUND OF THE INVENTION

The present invention relates to an upright dispenser for supporting a roll of paper towels.

Dispensers for rotatably supporting a roll of paper towels in an upright state are known, e.g., see U.S. Pat. Nos. 4,487,376; 4,792,102; 5,467,956; and DES. 298,290, for example. Such dispensers are characterized by a base and an upright post projecting from the base and sized to fit loosely within a center core of the roll, permitting the roll to rotate when a user applies an unwinding force to an endmost sheet of the roll.

A problem involved in the use of such dispensers results from the manner of manufacturing the rolls themselves. That is, a wide sheet of toweling is wound on a long disposable (usually cardboard) core to form a long roll which is then cut by saw blades to the commercially desirable lengths. During the cutting step it is not uncommon for the core to be deformed, i.e., wherein one side of the core is crushed toward an opposite side. As a result, it can be difficult to fit the core onto the post of the dispenser.

Also, when the core has been loaded on the dispenser, a lower end of the roll bears against an upwardly facing surface of the dispenser. The resulting friction between the roll and dispenser during unwinding of the roll can cause the roll to bind and inhibit the dispensing action.

It is, therefore, an object of the invention to minimize or obviate problems of the above-described type.

SUMMARY OF THE INVENTION

The object of the invention is achieved by an upright dispenser adapted to support a roll of paper towels wound on a disposable core. The dispenser comprises a base adapted to be supported on a support surface, and a post projecting upwardly from the base and sized to be received within the core of the roll. A top surface of the post is slanted obliquely relative to a longitudinal axis of the post, whereby one side of the top surface is higher than a diagonally opposite side thereof.

Recesses are provided in the base for receiving fasteners adapted to fix the dispenser to a vertical support surface.

The base preferably includes a platform projecting upwardly from an upper face of the base. The platform extends around a lower end of the post and is of a diameter smaller than a largest diameter of a full roll of paper towels for raising a bottom end of the roll above the upper face of the base.

BRIEF DESCRIPTION OF THE DRAWING

The objects and advantages of the invention will become apparent from the following detailed description of a preferred embodiment thereof in connection with the accompanying drawing in which like numerals designate like elements and in which.

DETAILED DESCRIPTION OF A PREFERRED EMBODIMENT OF THE INVENTION

Figure 1:
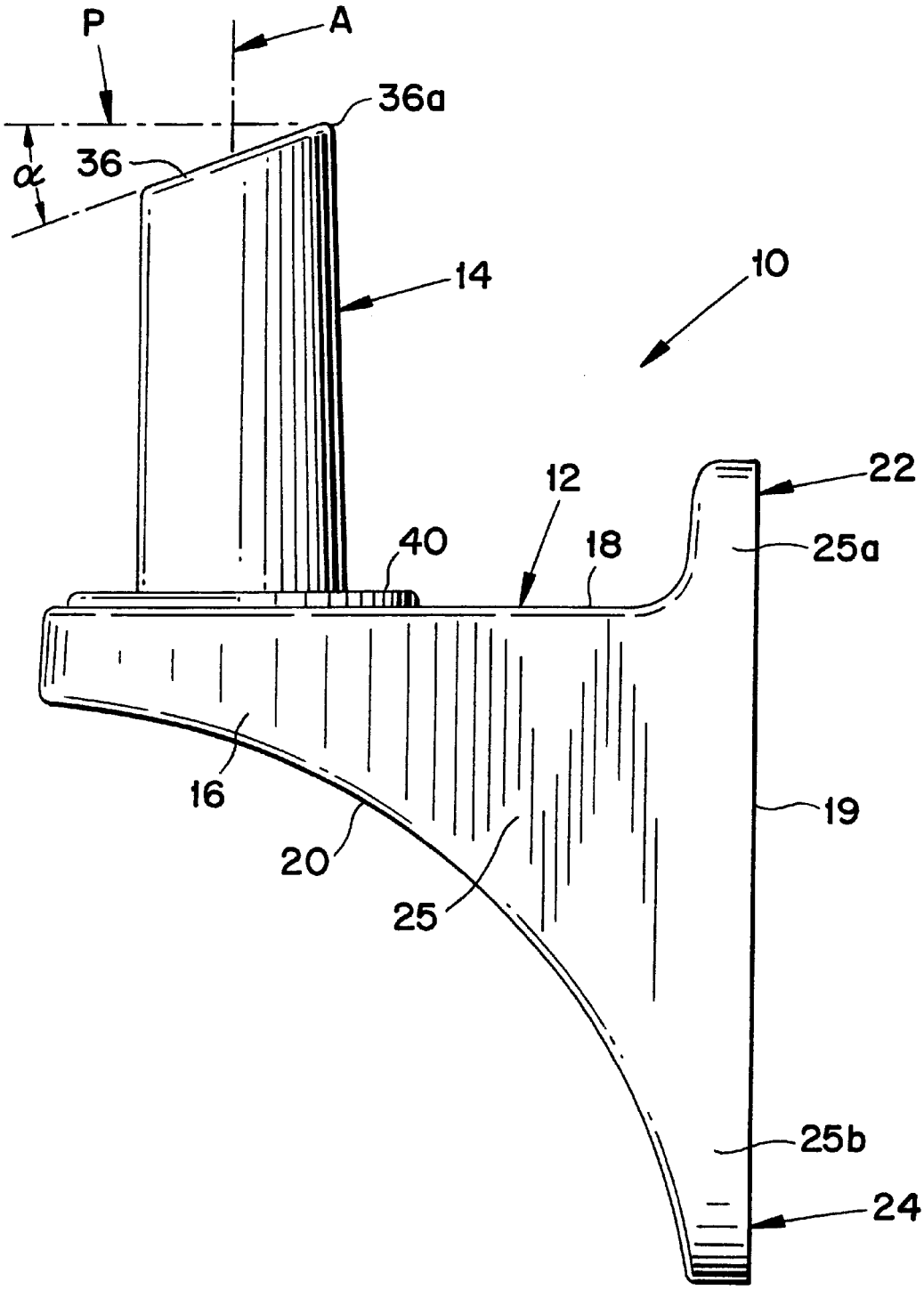
FIG. 1 is a side elevational view of a dispenser according to the present invention.
Figure 2:
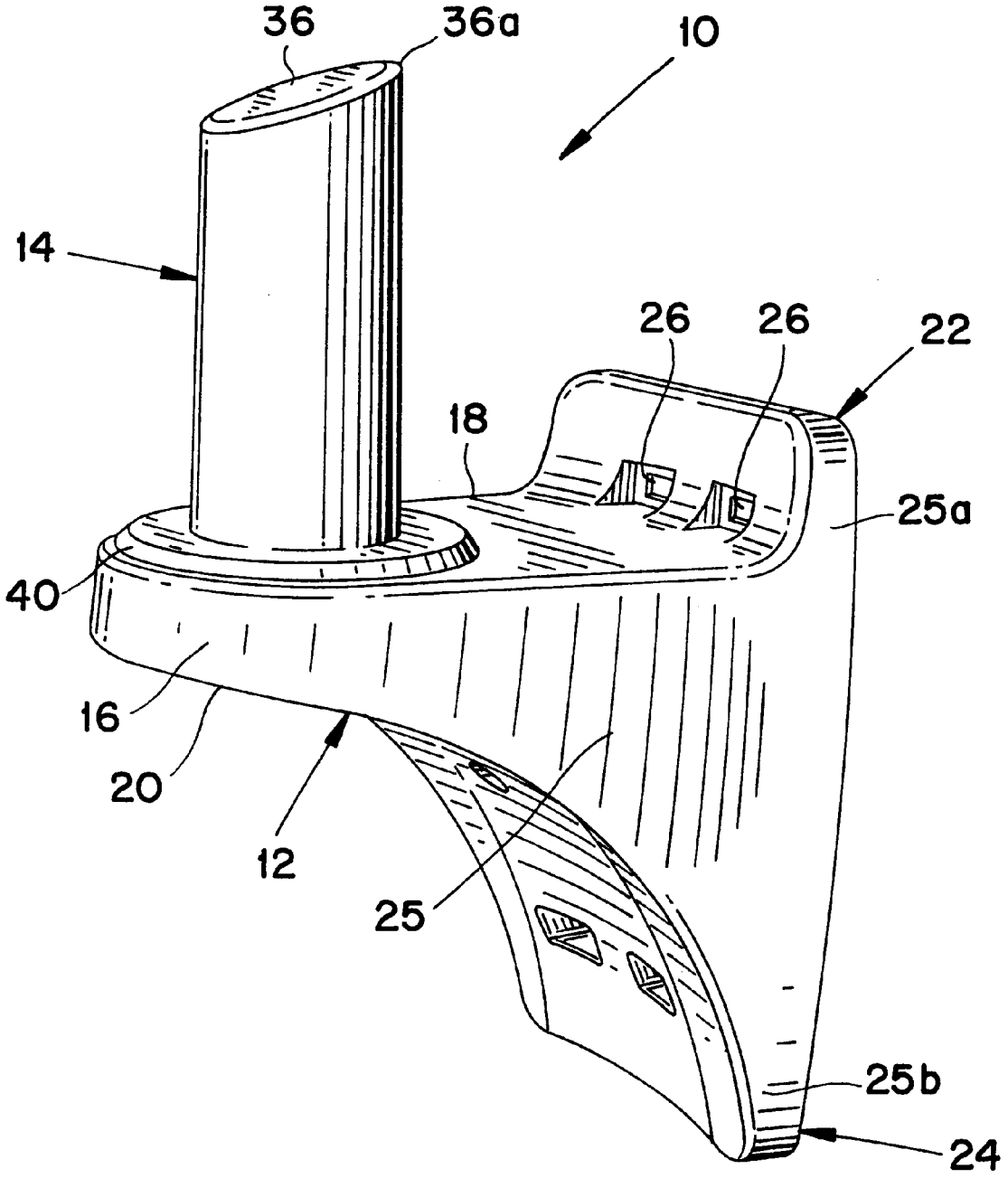
FIG. 2 is a top front perspective view of the dispenser depicted in FIG. 1.
Figure 3:
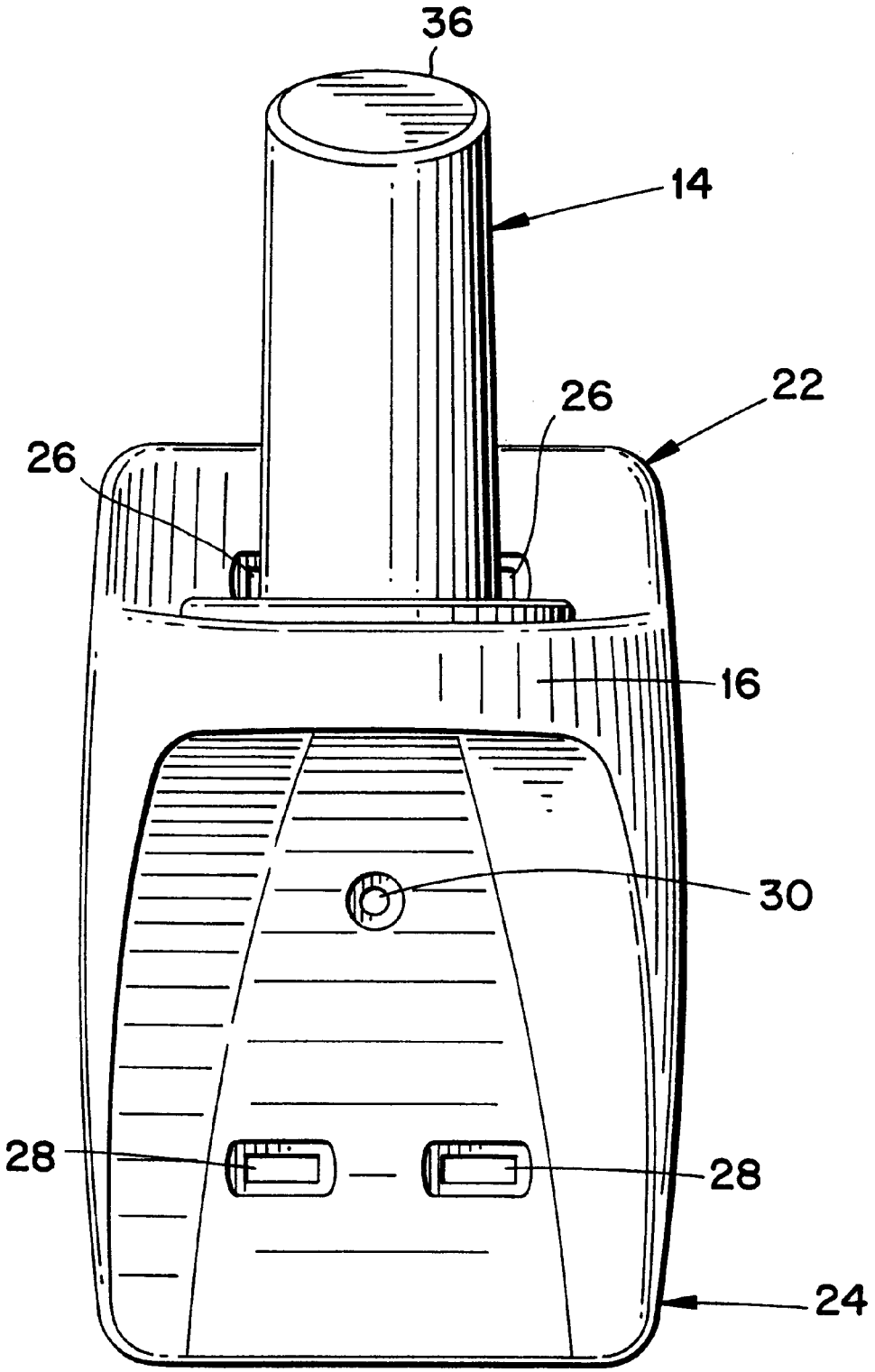
FIG. 3 is a front elevational view of the dispenser.
Figure 4:
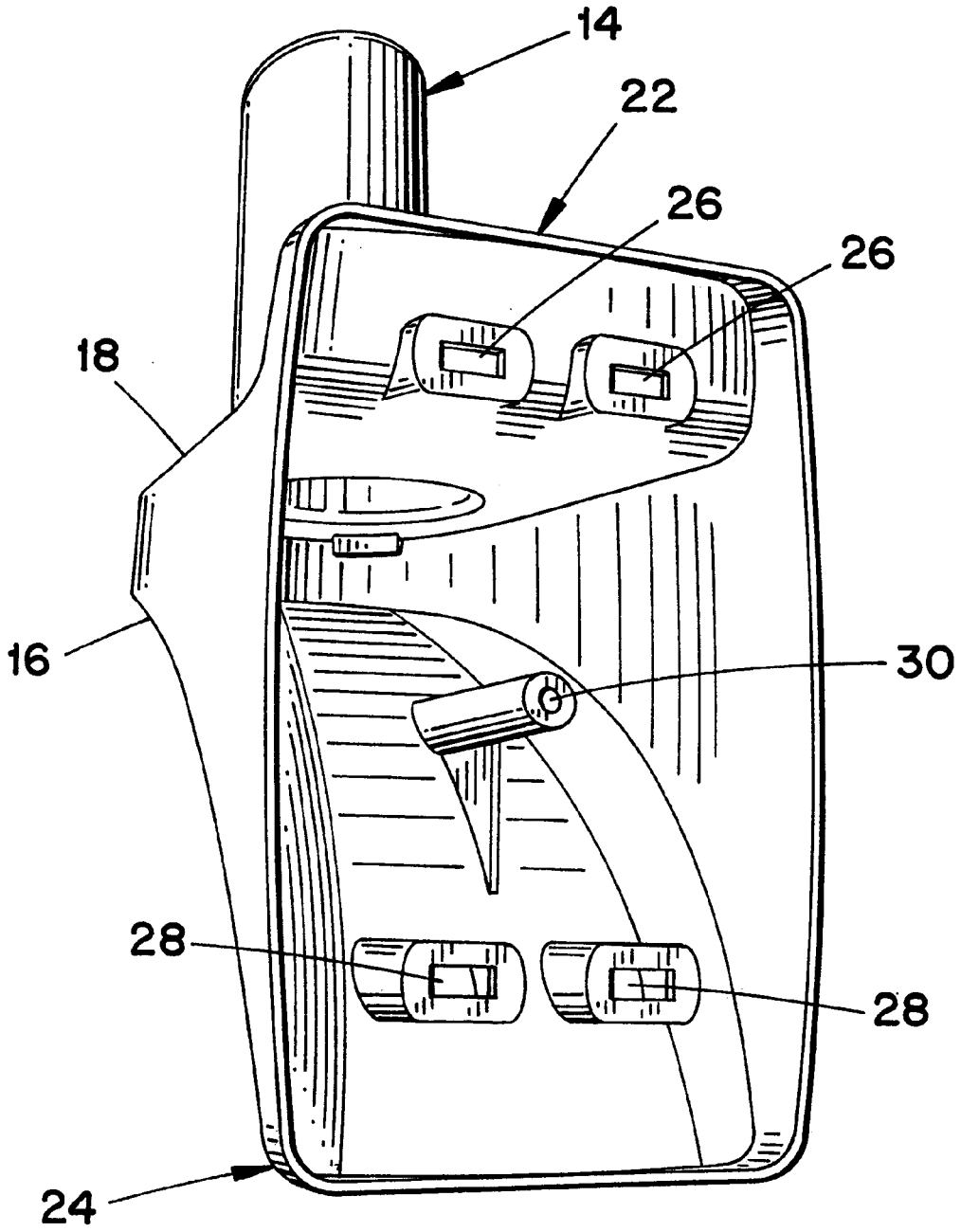
FIG. 4 is a lower rear perspective view of the dispenser.

An upright dispenser 10 for a roll of paper towels comprises a base 12 and an integral post 14 formed of a single piece of molded plastic. The base 12 includes a horizontal leg 16 forming upper and lower faces 18, 20, respectively. Upper and lower flanges 22, 24 project from one side of the leg 16 and form a vertical side surface 19. A side face 25 of the leg is contiguous with side faces 25*a*, 25*b* of the upper and lower flanges. The upper flange 22 includes a pair of horizontal recesses 26 which straddle the post 14 as viewed in FIG. 3, to enable screw fasteners (not shown) to be inserted through the upper recesses 26, as well as through a pair of lower horizontal recesses 28 extending through the lower flange 24. The fasteners enable the base 12 to be secured to a vertical support wall.

An additional horizontal recess 30 can be formed through the base between the upper and lower recesses 26, 28 for releasably attaching the base to a wall-mounted bracket.

The post, which is cylindrical, extends upwardly, i.e., in a direction orthogonally to the horizontal axes of the recesses 26, 28. A top surface 36 of the post is slanted obliquely relative to a longitudinal axis A of the post. Preferably, the surface 36 forms an acute angle $\alpha$ of about 20° with a plane P extending perpendicularly to the axis A, although the angle $\alpha$ could be larger or smaller.

A circular platform 40 is disposed on the flat upper face 18 of the leg 16 in surrounding relationship to a lower end of the post 14. The platform 40, which is elevated with respect to the upper face 18, is of smaller diameter than a maximum diameter of a roll of towels, whereby a center portion of a bottom end of the roll rests on the platform, causing the rest of the bottom end of the roll to be spaced above the upper face 18. Accordingly, friction generated between the roll and the base during the unwinding of towels is minimized, so binding of the roll is resisted.

Preferably, the radius of the platform 40 is approximately equal to or greater than (i.e., not substantially smaller than) the sum of: (i) the radius of the post 14, plus (ii) twice the difference between the radius of the inner core of the towel roll and the radius of the post.

The platform is preferably stationary with respect to the upper face 18 of the leg 16, and is preferably concentric about the post 14.

In use of the dispenser 10, screw fasteners are inserted through the upper and lower recesses 26, 28 in order to secure the base directly to a wall, or alternatively, a screw could be inserted through the center recess 30 for locking the base to a wall-mounted bracket. Thus, the post 14 is oriented in an upright direction. To load a roll of towels, the center core of the roll is inserted downwardly onto the post. In the event that the core has been crushed during the manufacturing process, insertion onto the post will be facilitated by the slanted top surface 36 thereof, because only a small cross section of the post needs to initially enter the core. Furthermore, since the crushing of a core usually results in the remaining (uncrushed) opening being located close to one side of the core (rather than in the core center) the uppermost side 36*a* of the top surface 36 will be ideally located at one side of the post. Hence, the user can rotate the roll to locate the remaining opening of the crushed core in vertical alignment with the uppermost side 36*a* of the top surface 36 in order to facilitate an initial insertion of the core onto the post. Then, by means of a wedging action, the slanted surface 36 will displace the crushed side of the core back to its original shape, as the roll is pushed downwardly onto the post.

During the unwinding of paper sheets from the roll, the bottom end of the roll encounters minimal frictional resistance since it is raised above the upper face 18 of the base by the platform 40.

It will be appreciated from the foregoing that the present invention provides an upright dispenser which facilitates the loading of a roll of paper towels having a crushed center core and provides minimal frictional resistance to unwinding of the roll.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. An upright dispenser adapted to support a roll of paper towels wound on a disposable core, comprising a base adapted to be supported on a wall and a generally cylindrical post projecting upwardly from the base and sized to be received within the core of the roll, a top surface of the post being slanted obliquely relative to a longitudinal axis of the post, whereby one side of the top surface is higher than a diagonally opposite side thereof and constitutes the highest part of the top face, the base including a vertical side surface for abutting against the wall, the post extending parallel to the vertical side surface, the highest part of the top surface of the post being situated closer to the wall than is any other portion of the top surface.

2. The dispenser according to claim 1 wherein the base includes a plurality of recesses extending orthogonally relative to the longitudinal axis of the post for receiving fasteners adapted to fix the dispenser to a vertical support surface.

3. The dispenser according to claim 2 wherein the base includes a horizontal leg forming upper and lower faces, the post projecting from the upper face; the base including upper and lower flanges disposed at one end of the horizontal leg, the recesses extending through at least one of the flanges.

4. The dispenser according to claim 3 wherein the base further includes a platform projecting upwardly from the upper face and extending around a lower end of the post, the platform being of a diameter smaller than a largest diameter of a full roll of paper towels for raising a bottom end of the roll above the upper face.

5. The dispenser according to claim 4 wherein the base and post are integral and formed of one piece of a plastic material.

6. The dispenser according to claim 1 wherein the base includes an upper face from which the post projects, the base further including a platform projecting upwardly from the upper face and extending around a lower end of the post, the platform being of a diameter smaller than a largest diameter of a full roll of paper towels for raising a bottom end of the roll above the upper face.

7. The dispenser according to claim 1 wherein the base further includes a platform projecting upwardly from the upper face and extending around a lower end of the post, the platform being stationary with respect to the base.

8. The dispenser according to claim 1 wherein the base further includes a platform projecting upwardly from the upper face and extending around a lower end of the post, the platform being concentric about the post.

9. The dispenser according to claim 1 wherein the base further includes a platform projecting upwardly from the upper face and extending around a lower end of the post, wherein a radius of the platform is approximately equal to or greater than the sum of a radius of the post, plus twice the difference between a radius of the inner core and the radius of the post.

10. An upright dispenser adapted to support a roll of paper towels wound on a disposable core, comprising a base adapted to be supported on a support surface, and a post projecting upwardly from the base and sized to be received within the core of the roll; the base including a horizontal leg forming upper and lower faces, the upper face being flat and the lower face being concave; the post projecting from the upper face; the base including upper and lower flanges disposed at one end of the horizontal leg; the leg having a side face which is contiguous with side faces of the upper and lower flanges; recesses extending through the upper and lower flanges in directions oriented orthogonally relative to the longitudinal axis of the post for mounting the dispenser to a vertical support; the base further including a platform projecting upwardly from the upper face and extending concentrically around a lower end of the post; the platform being of a diameter smaller than a largest diameter of a full roll of paper towels for raising a bottom end of the roll above the upper face; a radius of the platform being no smaller than the sum of a radius of the post, plus twice the difference between a radius of the inner core and the radius of the post.

11. The dispenser according to claim 10 wherein a top surface of the post is slanted obliquely relative to a longitudinal axis of the post, whereby one side of the top surface is higher than a diagonally opposite side thereof.

12. An upright dispenser adapted to support a roll of paper towels wound on a disposable core, comprising a base adapted to be supported on a support surface, and a post projecting upwardly from the base and sized to be received within the core of the roll, a top surface of the post being slanted obliquely relative to a longitudinal axis of the post, whereby one side of the top surface is higher than a diagonally opposite side thereof, wherein the base includes an upper face from which the post projects, the base further including a platform projecting upwardly from the upper face and extending around a lower end of the post, the platform being of a diameter smaller than a largest diameter of a full roll of paper towels for raising a bottom end of the roll above the upper face.

13. An upright dispenser adapted to support a roll of paper towels wound on a disposable core, comprising a base adapted to be supported on a support surface, and a post projecting upwardly from the base and sized to be received within the core of the roll, a top surface of the post being slanted obliquely relative to a longitudinal axis of the post, whereby one side of the top surface is higher than a diagonally opposite side thereof, wherein the base further includes a platform projecting upwardly from the upper face and extending around a lower end of the post, the platform being stationary with respect to the base.

14. An upright dispenser adapted to support a roll of paper towels wound on a disposable core, comprising a base adapted to be supported on a support surface, and a post projecting upwardly from the base and sized to be received within the core of the roll, a top surface of the post being slanted obliquely relative to a longitudinal axis of the post, whereby one side of the top surface is higher than a diagonally opposite side thereof, wherein the base further includes a platform projecting upwardly from the upper face and extending around a lower end of the post, the platform being concentric about the post.

15. An upright dispenser adapted to support a roll of paper towels wound on a disposable core, comprising a base adapted to be supported on a support surface, and a post projecting upwardly from the base and sized to be received within the core of the roll, a top surface of the post being slanted obliquely relative to a longitudinal axis of the post, whereby one side of the top surface is higher than a diagonally opposite side thereof, wherein the base further includes a platform projecting upwardly from the upper face and extending around a lower end of the post, wherein a radius of the platform is approximately equal to or greater than the sum of a radius of the post, plus twice the difference between a radius of the inner core and the radius of the post.

* * * * *